United States Patent [19]

Husso

[11] Patent Number: 4,651,452

[45] Date of Patent: Mar. 24, 1987

[54] APPARATUS FOR SNOW REMOVAL

[75] Inventor: Voitto L. S. Husso, Ranta, Finland

[73] Assignee: Kuuslahden Konepaja Oy, Finland

[21] Appl. No.: 740,265

[22] PCT Filed: Sep. 27, 1984

[86] PCT No.: PCT/FI84/00069

§ 371 Date: May 22, 1985

§ 102(e) Date: May 22, 1985

[87] PCT Pub. No.: WO85/01534

PCT Pub. Date: Apr. 11, 1985

[30] Foreign Application Priority Data

Sep. 27, 1983 [FI] Finland ..... 833,482

[51] Int. Cl.[4] ..... E014 5/09

[52] U.S. Cl. ..... 37/225; 37/249; 37/250; 37/257; 37/260

[58] Field of Search ..... 37/249, 250, 254, 255, 37/260, 257, 225, 213, 261

[56] References Cited

U.S. PATENT DOCUMENTS

| | | | |
|---|---|---|---|
| 1,392,739 | 10/1921 | Bebow | 37/250 |
| 1,708,376 | 4/1929 | Cook | 37/225 |
| 3,303,588 | 2/1967 | Krause | 37/250 |

FOREIGN PATENT DOCUMENTS

| | | | |
|---|---|---|---|
| 454349 | 1/1949 | Canada | 37/250 |

*Primary Examiner*—Edgar S. Burr

*Assistant Examiner*—Moshe I. Cohen

*Attorney, Agent, or Firm*—McGlew and Tuttle

[57] ABSTRACT

A snow remover to be used in connection with a truck or other suitable vehicle. The apparatus comprises a snow container which moves on the ground scooping up snow like a snow shovel and is provided with at least one spiral conveyor and a discharge pipe. The snow gathered in the snow container by the spiral conveyor is let out through the discharge pipe, which pipe is provided with a choker. The spiral conveyor (3) is installed within the snow container (1) in a vertical position so that only its bottom part (31) is attached to the snow container. The spiral conveyor (3) has a conical form and is fitted within a conical sheath (5). The top part of the sheath thus forms the choker (52), which is connected to the bottom part (41) of the discharge pipe. The discharge pipe (4) has a cross-sectional area larger than that of the choker (52). The discharge pipe (4) is curved, and its radius of curvature (R) is constant. The discharge pipe (4) is formed of two parts, i.e. the bottom part (41) and the top part (42), which are interconnected by means of a hinge-like member (43). In between the two members (41,42) of the discharge pipe (4) there is installed a hydraulic cylinder (44), which is employed to bend down the top part (42) of the discharge pipe during transportation and storage. Moreover, the discharge pipe (4) is attached to the snow container (1) with bearings so that it can be turned in the horizontal plane.

8 Claims, 3 Drawing Figures

APPARATUS FOR SNOW REMOVAL

FIELD AND BACKGROUND OF THE INVENTION

The present invention relates to an apparatus for snow removal, arranged to be used in combination with a tractor or other suitable vehicle, the said apparatus comprising a snow container moving on the ground and scooping up snow like a snow shovel, which snow container is provided with at least one spiral conveyor and a discharge pipe, so that the snow gathered into the snow container by means of the spiral conveyor is let out through the discharge pipe which is furnished with a choker member or equivalent arrangement.

Generally snow is removed from roads mechanically by means of auxiliary equipment such as snow ploughs or snow blowers which are coupled to a suitable vehicle. If the snow must be transported away, as is the case in most towns and cities, separate loaders that can be attached for instance to a tractor are employed, by means of which loaders the snow piled along roads is lifted onto a truck pallet and transported to a special snow tip or storage area. Snow blowers can also be used so that the snow blower blows the snow directly onto the pallet of a truck or equivalent vehicle driving alongside the blower.

However, the above mentioned snow removal methods and apparatuses have many drawbacks. Snow removal costs rise comparatively high because the equipment is not used rationally. Progress in removing snow is slow irrespective of the auxiliary arrangements use. A large addition to the cost is due to the fact that the trucks generally drive to the snow areas underloaded because of the low bulk density of snow.

The Finnish Patent publication No. 57 158 introduces a snow remover which is provided with a snow container that is operated like a snow shovel and gathers snow therein, inside the snow container there is provided a horizontally rotated spiral conveyor, which is located transversally with respect to the driving direction. This spiral conveyor collects the snow to a certain spot within the snow container, to which spot there is installed another spiral conveyor which is inclined upwards and attached onto the side of the apparatus. The second spiral conveyor is encased within a tubular chamber. The snow is carried from the snow container by means of the second spiral conveyor through this tubular chamber. At the rear end of the chamber there is arranged a narrowing, through which the snow is pressed tight so that it forms a compact and brittle bar of snow.

The described snow remover has several advantages compared to other prior art apparatuses designed for removing snow from roads and other such areas. One of these advantages is the fact that the snow removal and transport costs are reduced because in the discharge phase the snow is pressed into a tight form and disposed either to the roadside or onto a pallet. The compact form of the snow also means that the snow tips can take in larger amounts of snow. Particularly during winters with exceptionally heavy snow, this makes the average snow transport routes shorter.

However, the above described snow remover also has its drawbacks. As it was stated before, the snow is removed from the snow container by means of a second spiral conveyor which is encased within a stiff tubular chamber, at the other end whereof is arranged a narrowing which functions as a choke nozzle. The tubular chamber cannot be turned or bent aside during the transportation of the snow remover. The chamber is always installed in a certain defined position. Consequently it is difficult to drive the apparatus under bridges and on narrow streets and roads.

During snow removal, this apparatus consumes a comparatively large amount of energy. The reason for this is that while the snow within the chamber of the second spiral conveyor is pressed into a remarkably compact substance, it needs to be pushed by considerable force through the narrowing at the end of the chamber. Moreover, the other end of the spiral conveyor is attached with bearings adjacent to the tubular narrowing, and this bearing arrangement with its fasteners adds to the friction which hinders the snow from moving forward in the chamber. At such spots where there is an exceptionally large snow bank, the spiral conveyor chamber may even be blocked.

SUMMARY OF THE INVENTION

The purpose of the present invention is to eliminate the above mentioned drawbacks and to realize a snow remover which is simple in construction and reliable in operation. This is achieved by means of the characteristic novel features which are listed in the claims.

Among the advantages of the present invention are the following. The spiral conveyor which shifts the snow further on from the snow container is in the present invention installed within the snow container, and what is more in such a fashion that there are no obstructions whatever for the progress of the snow at the top of the spiral. The choker which compresses the snow is located at the beginning of the snow discharge pipe, i.e. at the top end of the spiral conveyor, and the cross-sectional area of the snow discharge pipe is somewhat larger than that of the choker. Because of the combined effect of these innovations the snow travelling resistance, as well as the energy consumed in the working phase, are essentially reduced compared to the apparatus introduced in the above identified Finnish patent. The progress of the snow through the discharge pipe is further improved by making the discharge pipe curved with a constant radius of curvature. Thus the snow is pressed in the apparatus into a compact, uniform bar, which remains unbroken until it comes out of the discharge pipe and falls on the ground.

In the snow remover according to the invention, the snow discharge pipe can be easily turned to a desired direction and bent, during transportation, so that it requires a comparatively small space. In operation, the apparatus is easily controlled for instance from a tractor cabin, and the transportation does not bring about any problems.

BRIEF DESCRIPTION OF THE DRAWINGS

In the following the invention is described in detail with reference to the appended drawings, where.

DESCRIPTION OF THE PREFERRED EMBODIMENT

Figure 1:
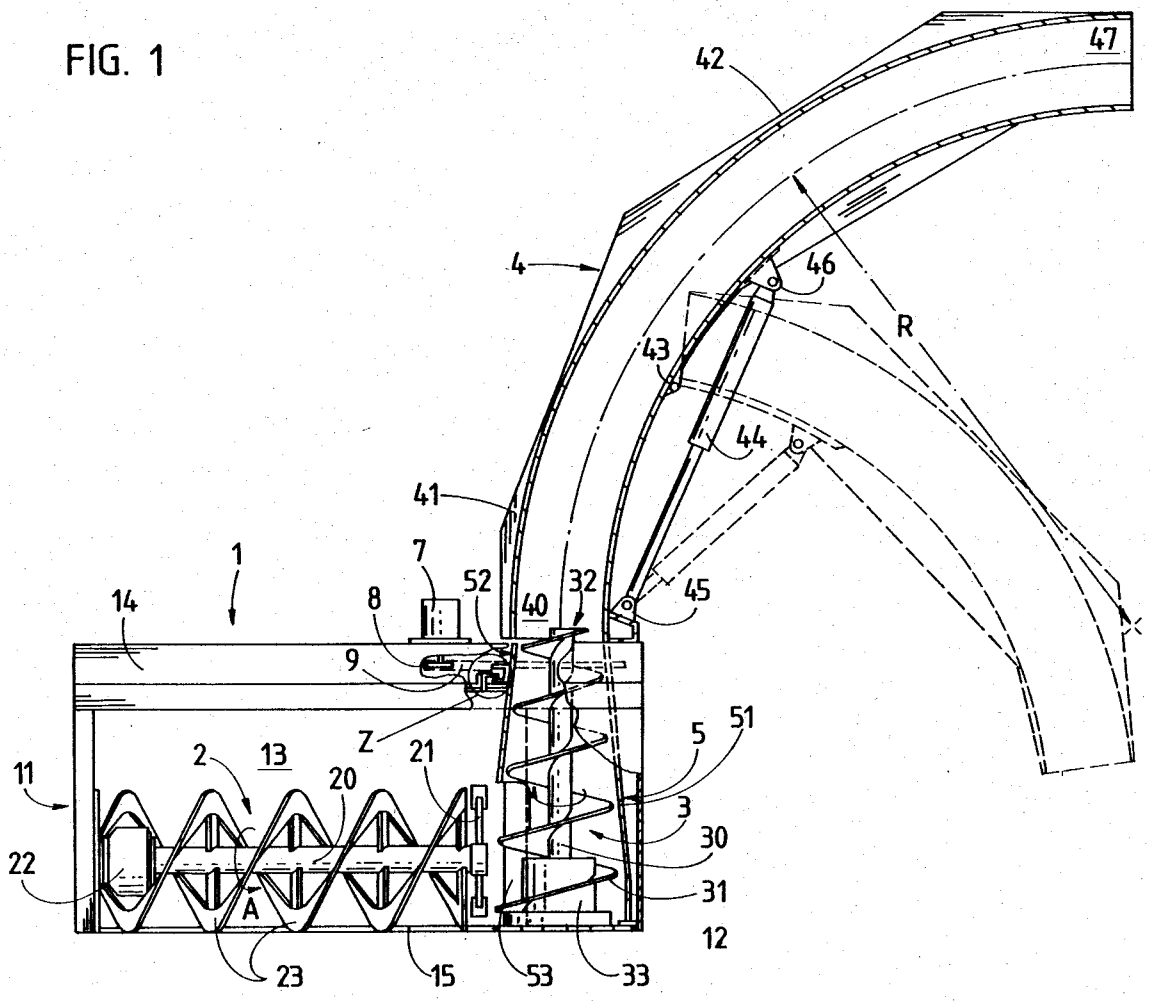
FIG. 1 is a schematic illustration of a snow remover according to the invention seen at the front in partial cross-section.
Figure 2:
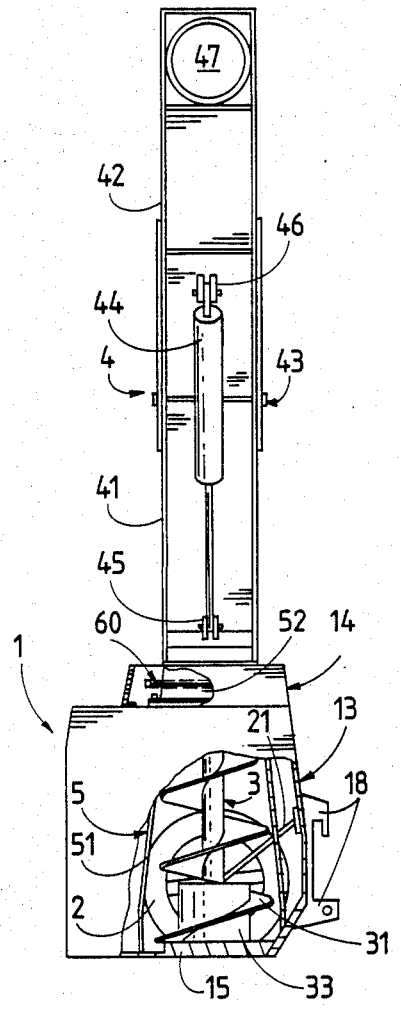
FIG. 2 is an illustration of the same snow remover seen from the side in partial cross-section.

In FIG. 1, the snow remover comprises a box-like snow container 1, two spiral conveyors 2, 3 and a snow discharge pipe 4. The snow container 1 is open at the front and otherwise formed of two side walls 11, 12, a rear part 13, a top part 14 and a bottom part 15. The spiral conveyors 2, 3 are fitted within the snow container 1, the first of them 2 horizontally and the second 3 vertically. The snow discharge pipe 4 is attached to the top part 14 of the snow container 1, in the neighbourhood of the top part 32 of the vertical spiral conveyor.

The first spiral conveyor 2 is located, in an essentially horizontal position with respect to the snow container, in between a first side wall 11 of the snow container 1 and the support 21, and the second spiral conveyor 3 is located, preferably vertically, in a parallel position with the side walls 11, 12, in between the other side wall 12 and the support 21. The other end of the shaft of the first spiral conveyor 2 is coupled to a first fluid motor 22, which runs the spiral conveyor. The second spiral conveyor 3 is attached to a bottom part 15 of a snow container 1 so that only the bottom part 31 of the spiral conveyor is supported, and the top part 32 is left unattached and fitted into the mouth aperture 40 of the bottom part 41 in the snow discharge pipe 4. The shaft 30 of the second spiral conveyor is coupled to the second fluid motor 33, which runs this spiral conveyor.

In the apparatus illustrated in the drawings, the blades 23, 24 of the spiral conveyors 2, 3 rotate on the side of the fluid motors 22, 23, seen in the direction of the axes 20, 30 so that on the first horizontal spiral conveyor 2 the blades 23 revolve counterclockwise and on the second vertical spiral conveyor 3 the blades 24 revolve clockwise. The spiral conveyors 2, 3 are, however, rotated in opposite directions A and B respectively. Thus the spiral conveyors convey and push the discharge snow mainly against the back part 13 of the snow container 1, or against other equivalent members, and further on towards the discharge pipe 4. This improves the co-operation of the spiral conveyors and intensifies the snow discharge from the container.

The second spiral conveyor 3, which is installed in a vertical position, is preferably conical so that the bottom part 31 is wider than the top part 32. It is fitted inside a conical sheath 5. On the side of the horizontal spiral conveyor 2, the sheath 5 is provided with an aperture and a guide plate 53. The area of the aperture matches that of the horizontal spiral conveyor 2 or is 10–15% larger than that. The cross-sectional area of the sheath 5 is larger at the bottom 51 than at the top 52. Thus the top part of the sheath forms the choker 52, which is attached to the bottom part 41 of the snow discharge pipe 4.

The snow discharge pipe 4 is curved, and its average radius of curvature R is constant. Thus it formes a section, preferably a quarter, of the circumference of a circle with the radius R. The radius of curvature of the discharge pipe can be chosen for instance according to the size of the apparatus. The cross-sectional area of the inside of the discharge pipe 4 is constant or grows slightly from the mouth aperture 40 towards the outlet 47. The cross-sectional area of the discharge pipe is preferably 10–20% larger than that the narrowest spot of the choker 52. Thus the snow, after being carried through the choker, can slide loosely and without compression friction through the discharge pipe and further out of it.

The snow discharge pipe 4 is attached to the snow container 1 with bearings, so that it can be turned essentially in horizontal position with respect to the snow container. In the embodiment illustrated in the drawings, this is realized so that the top part, i.e. the choker 52 of the sheath 5 is designed to form a separate moving member, which is attached with bearings to the top part 14 of the snow container 1.

Figure 3:
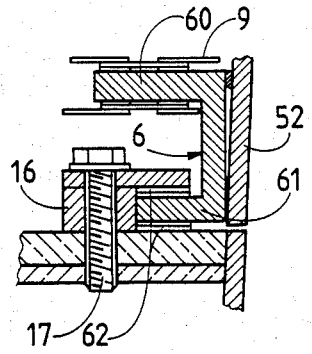
FIG. 3 is an illustration of a detail of the snow remover of FIG. 1.

The choker 52 can be furnished with bearings according to FIG. 3. FIG. 3 shows a detail 7 of FIG. 1 in enlarged scale. An annular bearing housing 16 is attached with screws 17 to the top part 14 of the snow container 1. Around the top part of the sheath 5, i.e. the choker 52, there is fitted a stationary barrel 6, which is fastened to its place for instance by welding. At its bottom edge the barrel 6 is furnished with a flange 61 and fitted into the barrel housing 16 by means of a thrust-bearing 62. Moreover, the top edge of the barrel 6 is provided with a first sprocket wheel 60.

On the top part 14 of the snow container 1 there is attached a fluid motor 7. To its axis is coupled a second sprocket wheel 8. The sprocket wheels 60, 8 are interconnected by means of a drive chain 9 or equivalent which rotates them. By means of the sprocket wheels 60, 8 and the drive chain 9, which are run by the fluid motor 7, the choker 52, as well as the snow discharge pipe 4 which is fixed thereinto in a preferably stationary manner, can be turned in any desired direction.

The snow discharge pipe 4 is advantageously formed of two parts, the bottom part 41 and a top part 42, which are attached to each other by means of a hinge-like member 43. To fastener lugs 45, 46 in between the two parts 41 and 42 of the discharge pipe 4 there is installed a hydraulic cylinder 44. By employing this cylinder, the top part 42 of the discharge pipe can, whenever desired, be bent down into a rest position which is illustrated by the dotted lines in FIG. 1. This procedure is recommendable for instance during the transportation and storage of the apparatus.

The snow remover of the invention is operated in the following manner. The apparatus is fastened by its fastener brackets 18 for instance to a tractor like an ordinary snow plough. The fluid motors 7, 22 and 33 of the apparatus, as well as the hydraulic cylinder 44, are coupled to the power system of the tractor by means of suitable pressure tubes and pipes. The snow discharge pipe 4 is lifted into working position by means of the hydraulic cylinder 44. Thereafter the snow discharge pipe 4 is turned, by means of the fluid motor 7, to a desired direction—for instance to the side as in FIG. 1, in which case the snow is discharged on the roadside or onto the pallet of a truck driving alongside the tractor.

Now the snow remover is ready for operation. The fluid motors of the spiral conveyors 2, 3 are started, and the tractor pushes the apparatus forward on the ground like an ordinary snow shovel or plough. In the course of driving, snow is gathered into the snow container, where the transversal, horizontally located spiral conveyor 2 presses it along the back part 13 and the guide plate 15 tdowards the aperture in the sheath 5 and further onto the vertically installed spiral conveyor 3. This spiral conveyor in its turn presses the snow through the sheath 5 and the choker 52 thereof, so that the snow is compressed into a compact bar. The snow discharge pipe 4 is larger than the choker 52 and has a curved form, wherefore the created bar of snow slides with only minor friction through the discharge pipe and is broken into pieces only after falling out of the pipe onto the roadside or the truck pallet.

In the above description the present invention has been explained with reference to only one preferred embodiment, but it is naturally clear that the invention can be modified in many ways without deviating from the principal idea of the invention. For example, the horizontal spiral conveyor can be replaced by a plate which is slanted with respect to the driving direction and ploughs the snow directly onto the vertical spiral conveyor. It is also possible to use alternatively several horizontal spiral conveyors which push the snow gathered into the snow container further on one or several vertical spiral conveyors. The number of snow discharge pipes is preferably one per each vertical spiral conveyor. The vertical conveyor can also be placed in a slightly slanted position, for instance in an angle between 80°–90° with respect to the horizontal. In the above description the driving motors are fluid motors and hydraulic cylinders, but other power generators can also be used. However, the use of hydraulic equipment is advantageous for many reasons, for instance because the operation of the snow remover can easily be arranged so that it is totally controlled from the cabin of the tractor or other vehicle, and the driver has the controls ready at hand. The hydraulic cylinder of the snow discharge pipe can be replaced by a mechanical locking device, which fastens the top and bottom parts of the pipe together into working position when the apparatus is in operation.

What is claimed is:

1. An apparatus for removing snow, to be used in connection with a vehicle, comprising a snow container 1 having a back part 13 which moves on the ground scooping up snow like a snow shovel and is provided with a rotatable vertical spiral conveyor 3 and a discharge pipe 4, said vertical spiral conveyor discharges the snow gathered into the snow container through the discharge pipe, the discharge pipe being furnished with a choker 52, the vertical spiral conveyor 3 being installed within the snow container 1, in substantially vertical position with only a bottom part 31 attached to the snow container, a rotatable horizontal spiral conveyor 2 installed within the snow container 1 in an essentially horizontal position, the rotating directions (A, B) of the horizontal 2 and vertical 3 spiral conveyors being arranged so that the spiral conveyors shift and push the discharge snow mainly against said back part 13 of the snow container 1 and further towards the discharge pipe 4, the vertical spiral conveyor 3 being conical in form and a conical sheath 5 enclosing said vertical spiral conveyor, the cross-sectional area of said conical sheath being larger at its bottom 51 than at its top, and that the top part of the sheath thus forming said choker 52, said choker being connected to the bottom of the snow discharge pipe 4.

2. The apparatus of claim 1, characterized in that the discharge pipe (4) has a cross-sectional area larger than that of the choker (52).

3. The apparatus of claim 1, characterized in that the discharge pipe (4) is curved and that its radius of curvature (R) is constant.

4. The apparatus of claim 1, characterized in that the discharge pipe (4) is connected to the snow container (1) with bearings so that it can be turned essentially in a horizontal plane.

5. The apparatus of claim 4, characterized in that the choker (52) of the sheath of the essentially vertical spiral conveyor (3) forms a separate member which is attached with bearings to a top part (14) of the snow container (1) and is provided with a first sprocket wheel (60), and that to the top part (14) of the snow container there is fixed a motor (7) whereto a second sprocket wheel (8) is coupled, and that the sprocket wheels (60, 8) are interconnected by means of a drive chain (9).

6. The apparatus of claim 5, characterized in that the discharge pipe (4) is formed of its bottom part (41) and top part (42), thereof which are interconnedted by means of a hinge-like member (43).

7. The apparatus of claim 6, characterized in that in between the two parts (41, 42) of the discharge pipe (4) there is installed a hydraulic cylinder (44) whereby the top part (42) of the discharge pipe (4) can be bent down.

8. A snow removal apparatus comprising:

a snow container having an open front with a bottom for scooping up snow, a back, a top and two side walls all connected together;

an inwardly tapering substantially vertical first spiral upwardly tapered conical conveyor rotatably mounted to said bottom of said container and disposed in said container for conveying snow upwardly out of said container;

first drive means for rotating said first conveyor;

a conical discharge sheath extending around said first conveyor and tapering upwardly, said sheath ending at a small diameter choke at a top thereof near said top of said container;

a curved discharge pipe having a larger diameter than said choke and connected to said top of said container above said choke for receiving snow from said sheath which is conveyed by said first conveyor out of said container;

a second substantially horizontal spiral conveyor in said container near said bottom;

second drive means connected to said second spiral conveyor, said first and second drive means connected to said first and second spiral conveyors for rotating said spiral conveyors in opposite direction for uging snow toward the back of said container, said second spiral conveyor having one end connected to one of said side walls in an opposite end adjacent said vertical spiral conveyor;

a support in said container rotably mounting said second end of said second spiral conveyor; and said discharge pipe being made of two pieces, a first piece being rotatably mounted to said top of said container for rotation in a horizontal plane, and said discharge part having a second part pivotally mounted to said first part with third drive means connected between said first first and second parts for pivoting said second part into a storage position with respect to said first part, said discharge pipe having a constant radius of curvature.

* * * * *